US007004514B2

(12) United States Patent
Franich

(10) Patent No.: US 7,004,514 B2
(45) Date of Patent: Feb. 28, 2006

(54) SAFETY LOCKING DEVICE

(75) Inventor: Greg Franich, Leitchfield, KY (US)

(73) Assignee: AP Technoglass, Bellefontaine, OH (US)

( * ) Notice: Subject to any disclaimer, the term of this patent is extended or adjusted under 35 U.S.C. 154(b) by 105 days.

(21) Appl. No.: 10/628,992

(22) Filed: Jul. 29, 2003

(65) Prior Publication Data

US 2005/0023839 A1 Feb. 3, 2005

(51) Int. Cl.
*E05C 19/10* (2006.01)

(52) U.S. Cl. ..... 292/108; 292/101; 414/407

(58) Field of Classification Search ..... 292/101, 292/108, 136, DIG. 55, 210; 248/147, 681; 414/407, 408; 128/883; 554/8
See application file for complete search history.

(56) References Cited

U.S. PATENT DOCUMENTS

| | | | | |
|---|---|---|---|---|
| 3,041,030 | A * | 6/1962 | Heimrich | 248/129 |
| 3,968,984 | A * | 7/1976 | Guth | 292/229 |
| 4,014,572 | A * | 3/1977 | Binns | 292/108 |
| 4,275,830 | A * | 6/1981 | McDonald | 232/43.1 |
| 4,345,868 | A | 8/1982 | Rizzo et al. | |
| 4,575,302 | A | 3/1986 | Holden | |
| 4,580,940 | A | 4/1986 | Sheaves | |
| 4,669,940 | A | 6/1987 | Englehardt et al. | |
| 4,966,514 | A | 10/1990 | Knapp | |
| 5,011,360 | A * | 4/1991 | Abram et al. | 414/424 |
| 5,090,753 | A | 2/1992 | Goodman | |
| 5,195,385 | A | 3/1993 | Johnson | |
| 5,201,434 | A | 4/1993 | DeVivo et al. | |
| 5,323,939 | A | 6/1994 | Young | |
| 5,448,945 | A | 9/1995 | Taylor et al. | |
| 5,474,413 | A | 12/1995 | Georg | |
| 5,551,336 | A | 9/1996 | Griffin et al. | |
| 5,853,277 | A | 12/1998 | Everhart | |
| 5,951,230 | A * | 9/1999 | Kruzick et al. | 414/421 |
| 6,027,297 | A | 2/2000 | Dungan | |
| 6,086,309 | A | 7/2000 | Mason et al. | |
| 6,106,072 | A | 8/2000 | Lutter, Jr. | |
| 6,113,340 | A | 9/2000 | Zalal | |
| 6,135,540 | A | 10/2000 | Dungan | |
| 6,154,911 | A | 12/2000 | Vanderlinden | |
| 6,257,358 | B1 | 7/2001 | Roach | |
| 2002/0071749 | A1 | 6/2002 | Hund, Jr. et al. | |

FOREIGN PATENT DOCUMENTS

| | | |
|---|---|---|
| EP | 0 092 134 A2 | 4/1983 |
| EP | 0 358 046 B1 | 11/1991 |

* cited by examiner

*Primary Examiner*—Gary Estremsky
(74) *Attorney, Agent, or Firm*—Harness, Dickey & Pierce, P.L.C.

(57) ABSTRACT

A locking device for a dumpster container, wherein the dumpster container is movable between an upright storing position and a tilted dumping position. The locking device includes a main locking device moveable between an engaged position, where the main locking device engages the dumpster container to retain the dumpster container in the upright storing position, and a disengaged position, where the main locking device disengages the dumpster container to permit movement of the dumpster container into the tilted dumping position. The locking device further includes a blocking plate pivotally coupled to the main locking device. The blocking plate is moveable between a blocking position, where the blocking plate prevents the main locking device from moving from the engaged position to the disengaged position, and an unblocking position. A handle linkage is pivotally coupled to the blocking plate and the main locking device and is moveable to move the blocking plate between the blocking position and the unblocking position. The blocking plate returns to the blocking position once the handle linkage is released.

15 Claims, 3 Drawing Sheets

SAFETY LOCKING DEVICE

FIELD OF THE INVENTION

The present invention generally relates to dumpsters and, more particularly, relates to a safety locking device for dumpsters.

BACKGROUND OF THE INVENTION

As is well known, refuse dumpsters for use in industrial applications typically include a container supported on a base structure. The container is often pivotable from a storage or upright position to a tilted or tilted dumping position relative to the base structure. To avoid inadvertent tilting of the container and, thus, the dumping of its contents, refuse dumpsters may be provided with a locking device to secure the container in the storage position. However, in response to human error and/or accidental actuation, an operator may fail to lock the container in the storage position, thereby leading to inadvertent and undesirable dumping or spilling of the dumpster contents.

Accordingly, there is a need in the relevant art to provide an inexpensive and effective safety locking device capable of preventing accidental tilting and/or dumping of dumpster containers. Furthermore, there is a need in the relevant art to overcome the disadvantages of the prior art.

SUMMARY OF THE INVENTION

According to the principles of the present invention, a locking device for a dumpster container is provided. The dumpster container is movable between an upright storing position and a tilted dumping position. The locking device includes a main locking device moveable between an engaged position, where the main locking device engages the dumpster container to retain the dumpster container in the upright storing position, and a disengaged position, where the main locking device disengages the dumpster container to permit movement of the dumpster container into the tilted dumping position. The locking device further includes a blocking plate pivotally coupled to the main locking device. The blocking plate is moveable between a blocking position, where the blocking plate prevents the main locking device from moving from the engaged position to the disengaged position, and an unblocking position. A handle linkage is pivotally coupled to the blocking plate and the main locking device and is moveable to move the blocking plate between the blocking position and the unblocking position. The blocking plate returns to the blocking position once the handle linkage is released.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
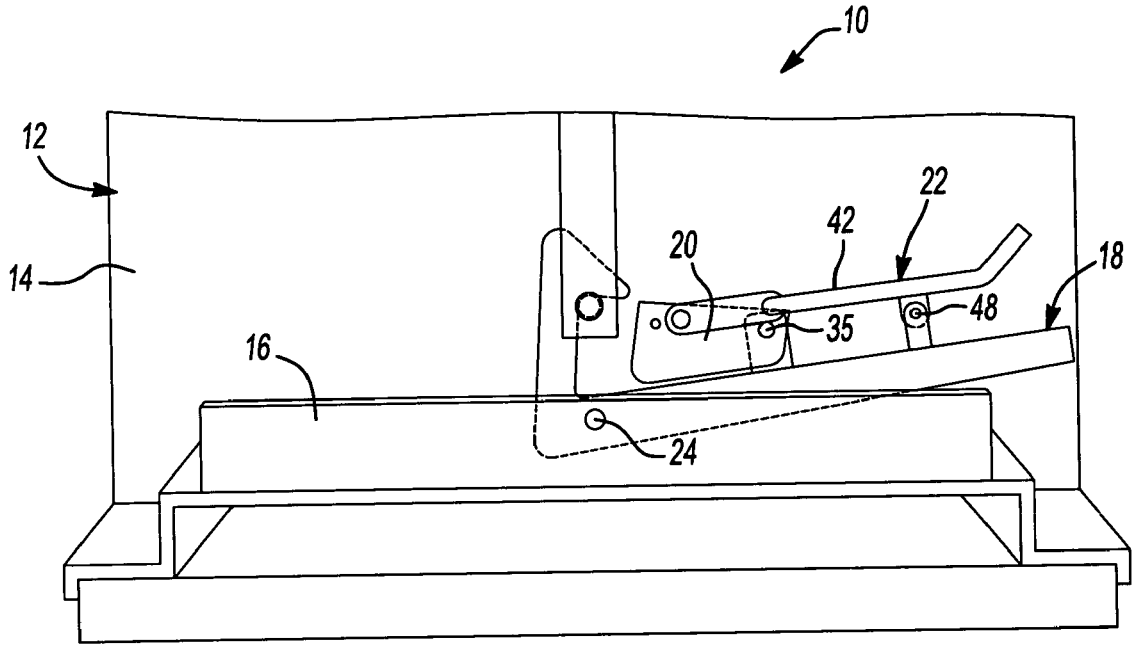
FIG. 1 is a front view illustrating a locking device according to the principles of the present invention, shown in a locking position.
Figure 2:
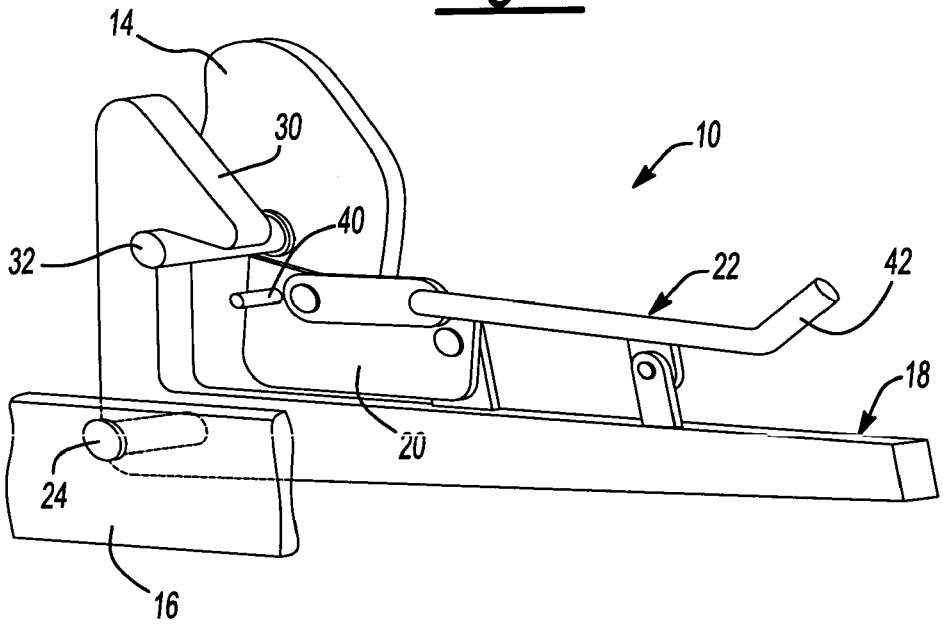
FIG. 2 is a side view illustrating the locking device of FIG. 1.

The following description of the preferred embodiments is merely exemplary in nature and is in no way intended to limit the invention, its application, or uses. It should be appreciated that the characterizations of various components and orientations described herein as being "vertical", "horizontal", "upright", "right", "left", "side", "top", or "bottom" are relative characterizations only based upon the particular position or orientation of a given component as illustrated. These terms shall not be regarded as limiting the invention.

With reference to FIGS. 1–6, a safety locking device 10 for use in locking and unlocking a dumpster 12 to prevent the inadvertent dumping of its contents is provided. Dumpster 12 is generally an industrial-type dumpster used for retaining, storing, and eventually disposing of refuse, such as glass fragments produced during the manufacture of automotive glass. Dumpster 12 includes a storage container 14 supported on a base structure 16 such that storage container 14 may tilt or otherwise pivot from an upright storage position (see FIG. 1) to a tilted dumping position (see FIG. 6). The movement of storage container 14 relative to base structure 16 from the upright storage position to the tilted dumping position may be facilitated through the use of biasing members (not shown), such as hydraulic actuators, springs, and the like, or may be manually completed.

Safety locking device 10 includes a main locking device 18, a blocking plate 20, and a handle locking device 22, which will each be discussed in detail below.

Figure 3:
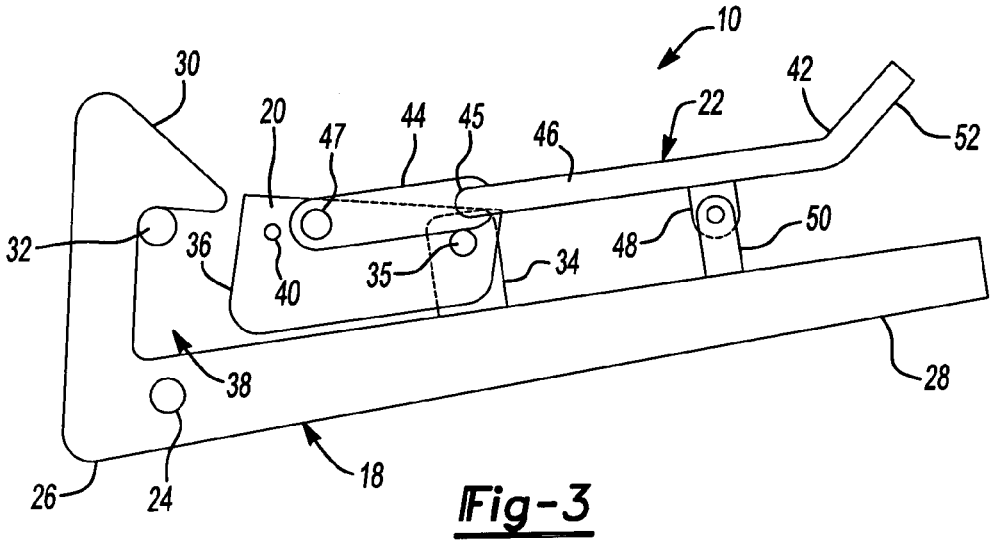
FIG. 3 is a schematic front view illustrating the locking device.

Still referring to FIGS. 1–6, main locking device 18 is pivotably coupled to base structure 16 via a pivot member 24. As best seen in FIG. 3, main locking device 18 includes a first end 26 and a second end 28. First end 26 of main locking device 18 includes an engaging member 30, such as a hook. Engaging member 30 is sized to engage and retain a shaft 32 extending from storage container 14 (see FIGS. 2 and 3). In operation, main locking device 18 pivots about pivot member 24 between an engaged position (see FIGS. 1–3) and a disengaged position (see FIGS. 4 and 5). When main locking device 18 is in the engaged position, engaging member 30 contacts and retains shaft 32 of storage container 14. When main locking device 18 is in the disengaged position, shaft 32 and thus storage container 14 are free to move relative to main locking device 18 and base structure 16 into the tilted dumping position. It should be appreciated that main locking device 18 may be any shape that provides adequate leverage.

Blocking plate 20 is provided so as to prevent main locking device 18 from inadvertently becoming disengaged from shaft 32. Blocking plate 20 is a generally planar, rectangular member having a face 36. Blocking plate 20 is pivotally mounted to a support bracket 34 extending from main locking device 18 for rotation about a pivot 35. As best seen in FIG. 3, blocking plate 20 is positioned relative to engaging member 30 such that blocking plate 20 blocks an opening 38 of engaging member 30 when in a lowered blocking position (see FIG. 3) and reveals opening 38 when in a raised unblocking position (see FIGS. 4 and 5). When blocking plate 20 is in the lowered blocking position (see FIG. 3), any disengaging movement of main locking device 18 (counter-clockwise rotation as viewed in the figures) will be prevented once shaft 32 contacts face 36 of blocking plate 20, thereby retaining storage container 14 in its upright storage position.

In order to pivot main locking device 18 into the disengaged position to permit storage container 14 to be raised to its tilted dumping position, blocking plate 20 must first be raised into the raised unblocking position (see FIGS. 4 and 5) to reveal opening 38. Once blocking plate 20 is the raised unblocking position, main locking device 18 is free to rotate and be disengaged from shaft 32 of storage container 14.

Blocking plate 20 may include an optional peg 40 that provides a convenient handle for aiding in the rotation of blocking plate 20 around pivot 35 between the raised and lowered positions. As will be explained below, peg 40 is merely optional because blocking plate 20 is biased to rotate automatically to the lowered blocking position in response to gravity.

Referring to FIG. 3, safety locking device 10 further includes a handle locking device 22 pivotally coupled to blocking plate 20 and main locking device 18 to prevent blocking plate 20 from becoming permanently placed in the raised unblocking position, which would permit the free and possibly inadvertent disengagement of main locking device 18 from shaft 32. To this end, handle locking device 22 includes an angularly shaped handle linkage 42 and an interconnecting linkage 44. Interconnecting linkage 44 is pivotally coupled between an end 46 of angularly shaped handle linkage 42 and blocking plate 20 at pivots 45 and 47, respectively. It should be understood that interconnecting linkage 44 may be eliminated if the proper leverage is achieved simply through blocking plate 20 and handle linkage 42.

Angularly shaped handle linkage 42 is further pivotally attached to main locking device 18 at pivot bracket 50 via pivot 48. Angularly shaped handle linkage 42 is shaped such that as angularly shaped handle linkage 42 pivots about pivot bracket 50 (clockwise in FIG. 3), a free end 52 thereof is generally parallel to and adjacent free end 28 of main locking device 18 (see FIGS. 4–6). This pivoting movement causes end 46 of angularly shaped handle linkage 42 to raise up, thereby applying a pulling force to interconnecting linkage 44 and blocking plate 20. Once free end 52 of angularly shaped handle linkage 42 is adjacent free end 28 of main locking device 18, then blocking plate 20 is raised sufficiently in the raised unblocking position to reveal opening 38. As can be seen from the figures, however, blocking plate 20 is not raised so high as to pass an overcenter condition. That is, blocking plate 20 can only be raised high enough to reveal opening 38 to unlock storage container 14, but once free end 52 of angularly shaped handle linkage 42 is released, blocking plate 20 will again return to a lowered blocking position, thereby ensuring storage container 14 is properly and safely retained.

Figure 4:
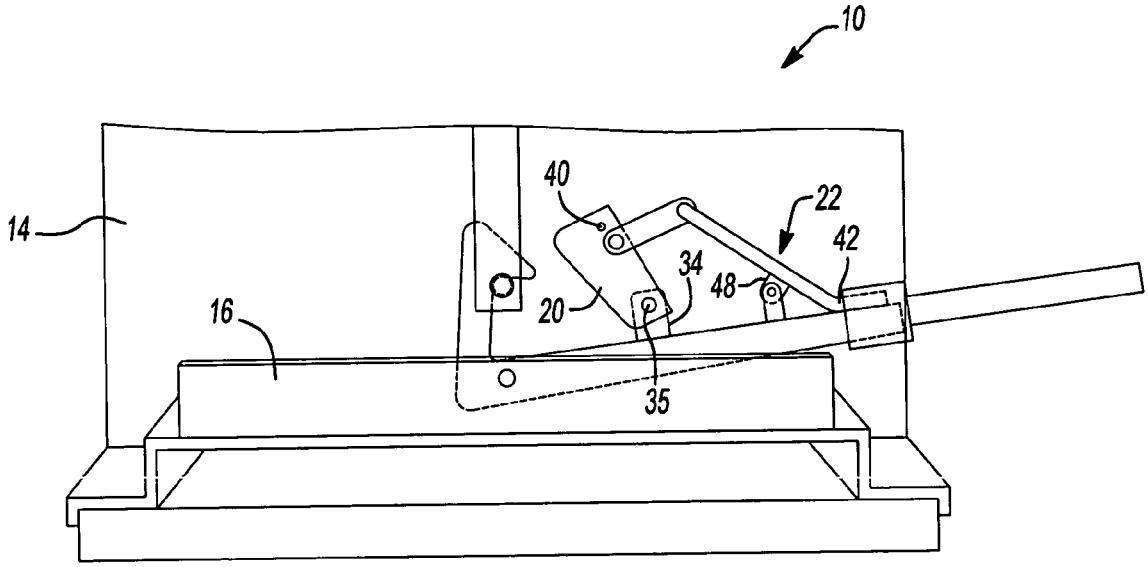
FIG. 4 is a front view illustrating the locking device of FIG. 1, shown in a first unlocking position.
Figure 5:
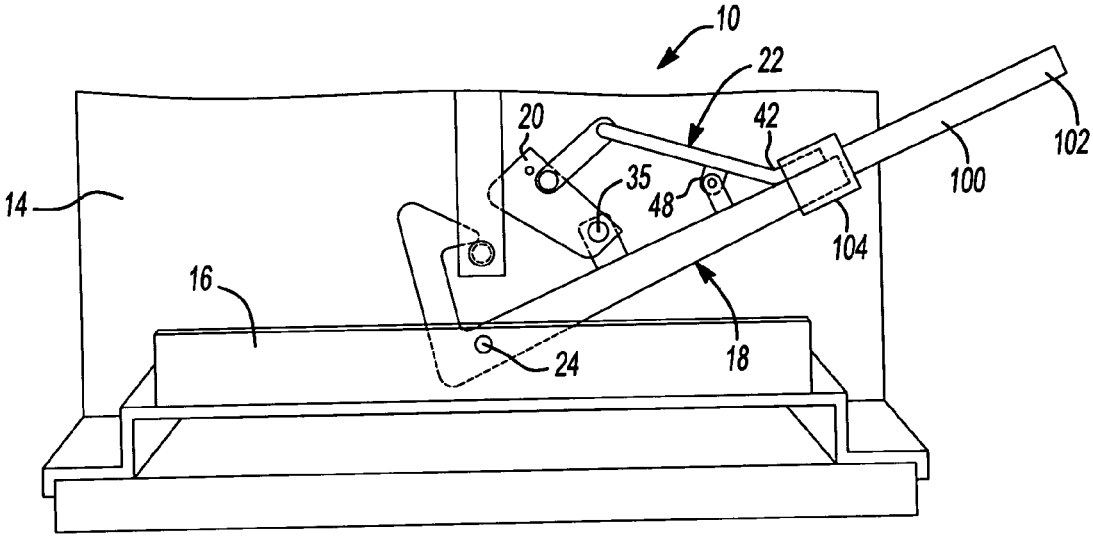
FIG. 5 is a front view illustrating the locking device of FIG. 1, shown in a second unlocking position.
Figure 6:
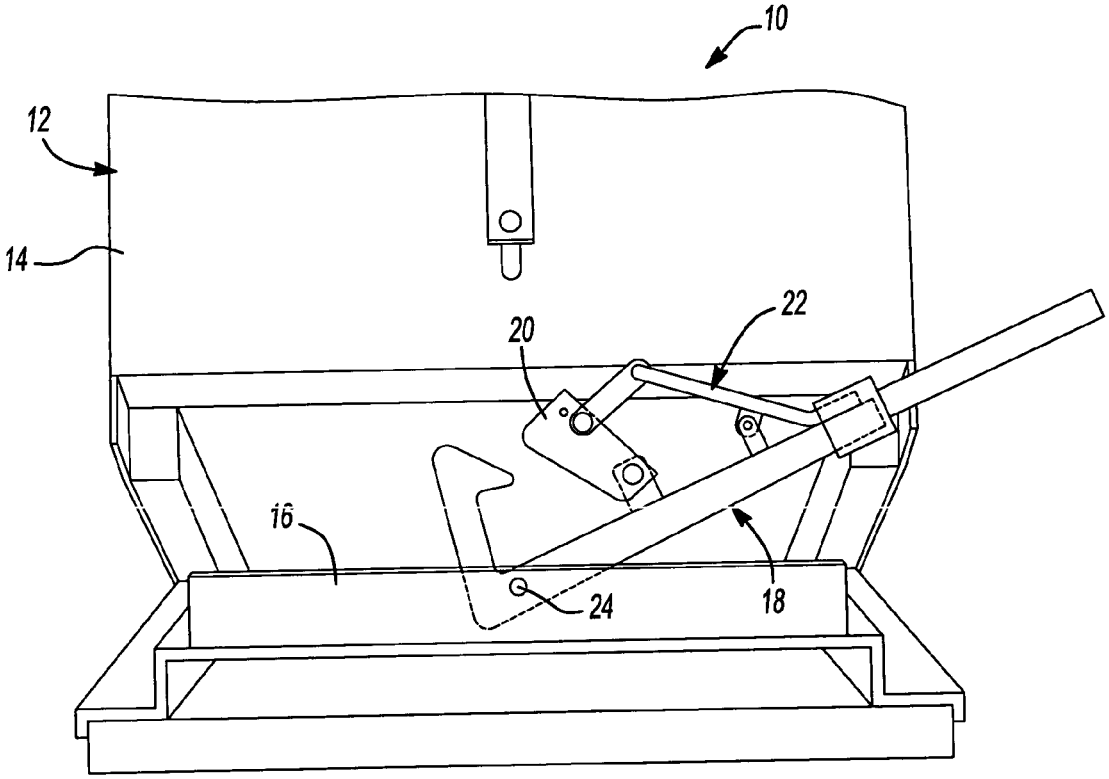
FIG. 6 is a front view illustrating the locking device of FIG. 1, shown in the unlocked and disengaged position.

As seen in FIGS. 4–6, safety locking device 10 further includes an optional handle extension 100, which includes a grasping end 102 and an engaging end 104. Engaging end 104 is preferably shaped such that it may be slipped over free end 52 of angularly shaped handle linkage 42 and free end 28 of main locking device 18, when free end 52 and free end 28 are adjacent. This provides a simple way to retain blocking plate 20 in the raised unblocking position while simultaneously permitting main locking device 18 to be rotated to the disengaged position to unlock storage container 14 from base structure 16. It should be noted that handle extension 100 is further sized such that if handle extension 100 is inadvertently left slipped over free end 52 and free end 28, it may be readily seen by workers in the area and will indicate that blocking plate 20 is in the raised unblocking position.

Alternatively, optional handle extension 100 may be eliminated, thereby requiring an operator to manually grasp free end 52 of angularly shaped handle linkage 42 and free end 28 of main locking device 18 to position blocking plate 20 in the raised unblocking position and then to actuate main locking device 18 to the disengaged position to unlock storage container 14 from base structure 16. Once the operator releases free end 52 of angularly shaped handle linkage 42 and free end 28 of main locking device 18, blocking plate 20 will again fall into the lowered blocking position, thereby preventing shaft 32 from exiting opening 38.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A locking device for a dumpster container, said dumpster container being movable between an upright storing position and a tilted dumping position, said locking device comprising:

a main locking device selectively moveable between an engaged position, where said main locking device engages the dumpster container to retain the dumpster container in the upright storing position, and a disengaged position, where said main locking device disengages the dumpster container to permit movement of the dumpster container into the tilted dumping position;

a blocking plate pivotally coupled to said main locking device, said blocking plate being selectively moveable between a blocking position, where said blocking plate prevents said main locking device from moving from said engaged position to said disengaged position, and an unblocking position;

an interconnecting linkage pivotally coupled at a first end to said blocking plate; and a handle linkage pivotally coupled to said main locking device and a second end of said interconnecting linkage, said handle linkage being selectively moveable to move said blocking plate between said blocking position and said unblocking position.

2. The locking device according to claim 1 wherein said unblocking position of said blocking plate occurs prior to an overcenter position.

3. The locking device according to claim 1 wherein said handle linkage is angularly shaped such that when said blocking plate is in said unblocking position, a free end of said handle linkage is generally parallel to and adjacent said main locking device.

4. The locking device according to claim 1, further comprising:

a handle extension simultaneously engagable with said handle linkage and said main locking device.

5. The locking device according to claim 1 wherein said blocking plate is biased into said blocking position in response to gravity.

6. A locking device for a container, said container being movable between an upright storing position and a tilted dumping position, said locking device comprising:

a main locking device selectively moveable between an engaged position, where said main locking device engages the container to retain the container in the upright storing position, and a disengaged position, where said main locking device disengages the container to permit movement of the container into the tilted dumping position;

a plate pivotally mounted on said main locking device, said plate being selectively moveable between a first position, where said plate prevents said main locking device from moving from said engaged position to said disengaged position, and a second position; and a handle linkage pivotally mounted on said main locking device and said plate, said handle linkage being selectively moveable to move said plate between said first position and said second position.

7. The locking device according to claim 6 wherein said plate is biased into said first position.

8. The locking device according to claim 6, further comprising:

an interconnecting linkage pivotally coupled between said handle linkage and said plate.

9. The locking device according to claim 6 wherein said handle linkage is angularly shaped such that when said plate is in said second position, a free end of said handle linkage is generally parallel to and adjacent said main locking device.

10. The locking device according to claim 6, further comprising:

a handle extension simultaneously engagable with said handle linkage and said main locking device.

11. The locking device according to claim 6 wherein said plate is biased into said first position in response to gravity.

12. A locking device for a container, said container being movable between an upright storing position and a tilted dumping position, said locking device comprising:

a main locking device selectively moveable between an engaged position, where said main locking device engages the container to retain the container in the upright storing position, and a disengaged position, where said main locking device disengages the container to permit movement of the container into the tilted dumping position;

a first plate pivotally coupled to said main locking device, said first plate being selectively moveable between a first position, where said first plate prevents said main locking device from moving from said engaged position to said disengaged position, and an second position;

a first linkage pivotally coupled to said first plate; and a second linkage pivotally coupled to said main locking device and said first linkage, said second linkage being selectively moveable to move said first plate between said first position and said second position.

13. The locking device according to claim 12 wherein said second linkage is angularly shaped such that when said first plate is in said second position, a free end of said second linkage is generally parallel to and adjacent said main locking device.

14. The locking device according to claim 12, further comprising:

a handle extension simultaneously engagable with said second linkage and said main locking device.

15. The locking device according to claim 12 wherein said first plate is biased into said first position in response to gravity.

* * * * *